US008317587B2

(12) United States Patent
Gomez et al.

(10) Patent No.: US 8,317,587 B2
(45) Date of Patent: Nov. 27, 2012

(54) GAMING SYSTEM HAVING FREE SPIN ENHANCEMENT FEATURES

(75) Inventors: Benjamin T. Gomez, Chicago, IL (US); Shridhar P. Joshi, Naperville, IL (US)

(73) Assignee: WMS Gaming Inc., Waukegan, IL (US)

( * ) Notice: Subject to any disclaimer, the term of this patent is extended or adjusted under 35 U.S.C. 154(b) by 289 days.

(21) Appl. No.: 12/740,306

(22) PCT Filed: Oct. 28, 2008

(86) PCT No.: PCT/US2008/012206

§ 371 (c)(1),
(2), (4) Date: Apr. 28, 2010

(87) PCT Pub. No.: WO2009/058256

PCT Pub. Date: May 7, 2009

(65) Prior Publication Data

US 2010/0261517 A1 Oct. 14, 2010

Related U.S. Application Data

(60) Provisional application No. 61/001,475, filed on Nov. 1, 2007.

(51) Int. Cl.
*A63F 9/24* (2006.01)

(52) U.S. Cl. ..... 463/16; 463/20

(58) Field of Classification Search ..... 463/16, 463/20

See application file for complete search history.

(56) References Cited

U.S. PATENT DOCUMENTS

| | | | | |
|---|---|---|---|---|
| 4,624,459 | A | 11/1986 | Kaufman | 273/143 R |
| 4,837,728 | A | 6/1989 | Barrie et al. | 364/412 |
| 4,861,041 | A | 8/1989 | Jones et al. | 273/292 |
| 4,948,134 | A | 8/1990 | Suttle et al. | 273/85 |
| 5,116,055 | A | 5/1992 | Tracy | 273/138 A |

(Continued)

FOREIGN PATENT DOCUMENTS

CA 2 334 546 8/2001

(Continued)

OTHER PUBLICATIONS

International Search Report corresponding to International Patent Application Serial No. PCT/US2008/012206, dated Jan. 8, 2009; 2 page.

(Continued)

*Primary Examiner* — Omkar Deodhar
(74) *Attorney, Agent, or Firm* — Nixon Peabody LLP

(57) ABSTRACT

A gaming system comprises a wager input device for receiving a primary wager, a display for displaying a primary wagering game, and a controller operative to (i) detect receipt of the primary wager, (ii) cause the display to present the randomly selected outcome selected from a plurality of possible outcomes, the plurality of possible outcomes including at least one free spin bonus outcome, (iii) determine if the randomly selected outcome is one of the at least one free spin bonus outcome, (iv) in response to the randomly selected outcome being the at least one free spin bonus outcome, provide a plurality of free spins and display a plurality of free spin enhancements which remain constant for the plurality of free spins, and (v) enhance an outcome of each of the free spins based on a player selection of at least one of the free spin enhancements for a subsequent free spin.

20 Claims, 6 Drawing Sheets

U.S. PATENT DOCUMENTS

| | | | | |
|---|---|---|---|---|
| 5,249,800 | A | 10/1993 | Hilgendorf et al. | 273/138 A |
| 5,275,400 | A | 1/1994 | Weingardt et al. | 463/12 |
| 5,280,909 | A | 1/1994 | Tracy | 273/138 A |
| 5,344,144 | A | 9/1994 | Canon | 273/138 A |
| 5,377,973 | A | 1/1995 | Jones et al. | 273/85 CP |
| 5,393,057 | A | 2/1995 | Marnell, II | 273/85 CP |
| 5,417,430 | A | 5/1995 | Breeding | 273/292 |
| 5,524,888 | A | 6/1996 | Heidel | 463/22 |
| 5,544,892 | A | 8/1996 | Breeding | 273/292 |
| 5,564,700 | A | 10/1996 | Celona | 463/27 |
| 5,577,959 | A | 11/1996 | Takemoto | 463/25 |
| 5,580,063 | A | 12/1996 | Edwards | 273/378 |
| 5,580,309 | A | 12/1996 | Piechowiak et al. | 463/16 |
| 5,611,730 | A | 3/1997 | Weiss | 463/20 |
| 5,645,486 | A | 7/1997 | Nagao et al. | 463/27 |
| 5,647,592 | A | 7/1997 | Gerow | 463/139 |
| 5,655,961 | A | 8/1997 | Acres et al. | 463/27 |
| 5,766,076 | A | 6/1998 | Pease et al. | 463/27 |
| RE35,864 | E | 7/1998 | Weingardt | 463/28 |
| 5,779,549 | A | 7/1998 | Walker et al. | 463/42 |
| 5,816,918 | A | 10/1998 | Kelly et al. | 463/16 |
| 5,820,459 | A | 10/1998 | Acres et al. | 463/25 |
| 5,823,874 | A | 10/1998 | Adams | 463/17 |
| 5,839,956 | A | 11/1998 | Takemoto | 463/25 |
| 5,848,932 | A | 12/1998 | Adams | 463/20 |
| 5,851,147 | A | 12/1998 | Stupak | 463/13 |
| 5,855,515 | A | 1/1999 | Pease et al. | 463/27 |
| 5,876,284 | A | 3/1999 | Acres et al. | 463/25 |
| 5,885,158 | A | 3/1999 | Torango et al. | 463/27 |
| 5,941,773 | A | 8/1999 | Harlick | 463/26 |
| 5,944,606 | A | 8/1999 | Gerow | 463/27 |
| 5,951,011 | A | 9/1999 | Potter et al. | 273/292 |
| 6,003,013 | A | 12/1999 | Boushy et al. | 705/10 |
| 6,007,066 | A | 12/1999 | Moody | 273/292 |
| 6,007,427 | A | 12/1999 | Wiener et al. | 463/17 |
| 6,012,982 | A | 1/2000 | Piechowiak et al. | 463/16 |
| 6,015,346 | A | 1/2000 | Bennett | 463/20 |
| 6,032,955 | A | 3/2000 | Luciano et al. | 273/138.1 |
| 6,047,963 | A | 4/2000 | Pierce et al. | 273/121 B |
| 6,089,976 | A | 7/2000 | Schneider et al. | 463/16 |
| 6,089,977 | A | 7/2000 | Bennett | 463/20 |
| 6,089,980 | A | 7/2000 | Gauselmann | 463/27 |
| 6,102,474 | A | 8/2000 | Daley | 296/836 |
| 6,102,799 | A | 8/2000 | Stupak | 463/27 |
| 6,110,043 | A | 8/2000 | Olsen | 463/27 |
| 6,139,013 | A | 10/2000 | Pierce et al. | 273/121 B |
| 6,142,872 | A | 11/2000 | Walker et al. | 463/16 |
| 6,146,273 | A | 11/2000 | Olsen | 463/27 |
| 6,155,925 | A | 12/2000 | Giobbi et al. | 463/20 |
| 6,158,741 | A | 12/2000 | Koelling | 273/292 |
| 6,159,097 | A | 12/2000 | Gura | 463/20 |
| 6,168,523 | B1 | 1/2001 | Piechowiak et al. | 463/26 |
| 6,190,255 | B1 | 2/2001 | Thomas et al. | 463/20 |
| 6,203,010 | B1 | 3/2001 | Jorasch et al. | 273/138.1 |
| 6,206,374 | B1 | 3/2001 | Jones | 273/292 |
| 6,206,782 | B1 | 3/2001 | Walker et al. | 463/25 |
| 6,210,275 | B1 | 4/2001 | Olsen | 463/16 |
| 6,210,277 | B1 | 4/2001 | Stefan | 463/27 |
| 6,217,448 | B1 | 4/2001 | Olsen | 463/25 |
| 6,220,593 | B1 | 4/2001 | Pierce et al. | 273/138.1 |
| 6,224,482 | B1 | 5/2001 | Bennett | 463/20 |
| 6,224,484 | B1 | 5/2001 | Okuda et al. | 463/27 |
| 6,231,445 | B1 | 5/2001 | Acres | 463/42 |
| 6,241,608 | B1 | 6/2001 | Torango | 463/27 |
| 6,254,483 | B1 | 7/2001 | Acres | 463/26 |
| 6,309,300 | B1 | 10/2001 | Glavich | 463/26 |
| 6,312,332 | B1 | 11/2001 | Walker et al. | 463/23 |
| 6,315,660 | B1 | 11/2001 | DeMar et al. | 463/16 |
| 6,319,125 | B1 | 11/2001 | Acres | 463/25 |
| 6,319,127 | B1 | 11/2001 | Walker et al. | 463/26 |
| 6,336,859 | B2 | 1/2002 | Jones et al. | 463/13 |
| 6,336,862 | B1 | 1/2002 | Byrne | 463/27 |
| 6,345,824 | B1 | 2/2002 | Selitzky | 273/292 |
| 6,347,996 | B1 | 2/2002 | Gilmore et al. | 463/17 |
| 6,358,149 | B1 | 3/2002 | Schneider et al. | 463/27 |
| 6,361,441 | B1 | 3/2002 | Walker et al. | 463/42 |
| 6,364,768 | B1 | 4/2002 | Acres et al. | 463/25 |
| 6,375,567 | B1 | 4/2002 | Acres | 463/25 |
| 6,375,568 | B1 | 4/2002 | Roffman et al. | 463/26 |
| 6,416,409 | B1 | 7/2002 | Jordan | 463/27 |
| 6,431,983 | B2 | 8/2002 | Acres | 463/25 |
| 6,435,968 | B1 | 8/2002 | Torango | 463/27 |
| 6,439,995 | B1 | 8/2002 | Hughs-Baird et al. | 463/20 |
| 6,443,452 | B1 | 9/2002 | Brune | 273/143 |
| 6,471,208 | B2 | 10/2002 | Yoseloff et al. | 273/143 |
| 6,482,089 | B2 | 11/2002 | DeMar et al. | 463/20 |
| 6,506,117 | B2 | 1/2003 | DeMar et al. | 463/20 |
| 6,508,707 | B2 | 1/2003 | DeMar et al. | 463/16 |
| 6,511,375 | B1 | 1/2003 | Kaminkow | 463/20 |
| 6,514,141 | B1 | 2/2003 | Kaminkow et al. | 463/25 |
| 6,517,433 | B2 | 2/2003 | Loose et al. | 463/20 |
| 6,520,855 | B2 | 2/2003 | DeMar et al. | 463/20 |
| 6,533,273 | B2 | 3/2003 | Cole et al. | 273/138.1 |
| 6,561,904 | B2 | 5/2003 | Locke et al. | 463/25 |
| 6,575,830 | B2 | 6/2003 | Baerlocher et al. | 463/20 |
| 6,577,733 | B1 | 6/2003 | Charrin | 380/251 |
| 6,589,115 | B2 | 7/2003 | Walker et al. | 463/25 |
| 6,592,458 | B1 | 7/2003 | Ho | 463/17 |
| 6,592,460 | B2 | 7/2003 | Torango | 463/27 |
| 6,599,186 | B1 | 7/2003 | Walker et al. | 463/17 |
| 6,599,188 | B2 | 7/2003 | Hirsch et al. | 463/19 |
| 6,599,193 | B2 | 7/2003 | Baerlocher et al. | 463/27 |
| 6,601,771 | B2 | 8/2003 | Charrin | 235/492 |
| 6,602,137 | B2 | 8/2003 | Kaminkow et al. | 463/16 |
| 6,609,973 | B1 | 8/2003 | Weiss | 463/20 |
| 6,634,943 | B1 | 10/2003 | Baerlocher | 463/25 |
| 6,648,758 | B2 | 11/2003 | Bennett et al. | 463/20 |
| 6,648,762 | B2 | 11/2003 | Walker et al. | 463/25 |
| 6,656,052 | B2 | 12/2003 | Abramopoulos et al. | 463/47 |
| 6,659,864 | B2 | 12/2003 | McGahn et al. | 463/16 |
| 6,663,489 | B2 | 12/2003 | Baerlocher | 463/20 |
| 6,676,513 | B2 | 1/2004 | Gauselmann | 463/20 |
| 6,712,694 | B1 | 3/2004 | Nordman | 463/20 |
| 6,712,695 | B2 | 3/2004 | Mothwurf et al. | 463/25 |
| 6,726,563 | B1 | 4/2004 | Baerlocher et al. | 463/25 |
| 6,729,618 | B1 | 5/2004 | Koenig et al. | 273/138.2 |
| 6,733,390 | B2 | 5/2004 | Walker et al. | 463/23 |
| 6,739,971 | B2 | 5/2004 | Devaull | 463/20 |
| 6,776,715 | B2 | 8/2004 | Price | 463/27 |
| 6,796,900 | B2 | 9/2004 | Baerlocher et al. | 463/16 |
| 6,796,905 | B2 | 9/2004 | Baerlocher et al. | 463/25 |
| 6,811,483 | B1 | 11/2004 | Webb et al. | 463/16 |
| 6,887,154 | B1 | 5/2005 | Luciano, Jr. et al. | 463/26 |
| 6,890,257 | B2 | 5/2005 | Baerlocher | 463/25 |
| 6,929,264 | B2 | 8/2005 | Huard et al. | 273/274 |
| 7,004,466 | B2 | 2/2006 | Gauselmann | 463/138 |
| 7,036,012 | B2 | 4/2006 | Charrin | 713/169 |
| 7,056,215 | B1 | 6/2006 | Olive | 463/27 |
| 7,121,942 | B2 | 10/2006 | Baerlocher | 463/20 |
| 7,390,260 | B2 | 6/2008 | Englman | 463/20 |
| 7,695,365 | B2 | 4/2010 | Casey | 463/20 |
| 2001/0004607 | A1 | 6/2001 | Olsen | 463/26 |
| 2001/0046893 | A1 | 11/2001 | Giobbi et al. | 463/24 |
| 2002/0025846 | A1 | 2/2002 | Bennett et al. | 463/20 |
| 2002/0138594 | A1 | 9/2002 | Rowe | 709/219 |
| 2002/0151345 | A1 | 10/2002 | Byrne | 463/18 |
| 2002/0155874 | A1 | 10/2002 | Byrne | 463/16 |
| 2003/0014370 | A1 | 1/2003 | Charrin | 705/65 |
| 2003/0027618 | A1 | 2/2003 | Byrne | 463/16 |
| 2003/0027625 | A1 | 2/2003 | Rowe | 463/20 |
| 2003/0036430 | A1 | 2/2003 | Cannon | 463/42 |
| 2003/0045337 | A1 | 3/2003 | Byrne | 463/16 |
| 2003/0050106 | A1 | 3/2003 | Lyfoung | 463/13 |
| 2003/0054872 | A1 | 3/2003 | Locke et al. | 463/20 |
| 2003/0060266 | A1 | 3/2003 | Baerlocher | 463/20 |
| 2003/0064776 | A1 | 4/2003 | Byrne | 463/16 |
| 2003/0064805 | A1 | 4/2003 | Wells | 463/39 |
| 2003/0069056 | A1 | 4/2003 | Cormack et al. | 463/16 |
| 2003/0109306 | A1 | 6/2003 | Karmarkar | 463/40 |
| 2003/0125102 | A1 | 7/2003 | Cannon | 463/20 |
| 2003/0148807 | A1 | 8/2003 | Acres | 463/40 |
| 2003/0148808 | A1 | 8/2003 | Price | 463/27 |
| 2003/0162583 | A1 | 8/2003 | Baerlocher et al. | 463/20 |
| 2003/0162585 | A1 | 8/2003 | Bigelow, Jr. et al. | 463/20 |
| 2003/0181231 | A1 | 9/2003 | Vancura et al. | 463/9 |
| 2003/0186733 | A1 | 10/2003 | Wolf et al. | 463/16 |
| 2003/0211879 | A1 | 11/2003 | Englman | 463/20 |

| | | | | |
|---|---|---|---|---|
| 2003/0211884 | A1 | 11/2003 | Gauselmann | 463/20 |
| 2003/0216166 | A1 | 11/2003 | Baerlocher et al. | 463/20 |
| 2003/0222402 | A1 | 12/2003 | Olive | 273/292 |
| 2003/0228899 | A1 | 12/2003 | Evans | 463/25 |
| 2003/0236116 | A1 | 12/2003 | Marks et al. | 463/16 |
| 2004/0002376 | A1 | 1/2004 | Swift et al. | 463/25 |
| 2004/0009808 | A1 | 1/2004 | Gauselmann | 463/25 |
| 2004/0009811 | A1 | 1/2004 | Torango | 463/25 |
| 2004/0018873 | A1 | 1/2004 | Hughs-Baird et al. | 463/20 |
| 2004/0023707 | A1 | 2/2004 | Maya et al. | 463/16 |
| 2004/0023716 | A1 | 2/2004 | Gauselmann | 463/23 |
| 2004/0038731 | A1 | 2/2004 | Englman | 463/25 |
| 2004/0038741 | A1 | 2/2004 | Gauselmann | 463/42 |
| 2004/0048644 | A1 | 3/2004 | Gerrard et al. | 463/16 |
| 2004/0048646 | A1 | 3/2004 | Visocnik | 463/16 |
| 2004/0048649 | A1 | 3/2004 | Peterson et al. | 463/20 |
| 2004/0053666 | A1 | 3/2004 | Vancura | 463/16 |
| 2004/0053672 | A1* | 3/2004 | Baerlocher | 463/20 |
| 2004/0063493 | A1 | 4/2004 | Baerlocher | 463/25 |
| 2004/0092304 | A1 | 5/2004 | George | 463/29 |
| 2004/0219967 | A1 | 11/2004 | Giobbi et al. | 463/16 |
| 2005/0003880 | A1 | 1/2005 | Englman | 463/16 |
| 2005/0055113 | A1 | 3/2005 | Gauselmann | 700/91 |
| 2005/0059467 | A1 | 3/2005 | Saffari et al. | 463/19 |
| 2005/0059472 | A1 | 3/2005 | Joshi et al. | 463/20 |
| 2005/0064930 | A1 | 3/2005 | Jubinville et al. | 463/17 |
| 2005/0070354 | A1* | 3/2005 | Baerlocher et al. | 463/20 |
| 2005/0096130 | A1 | 5/2005 | Mullins | 463/27 |
| 2005/0130731 | A1 | 6/2005 | Englman et al. | 463/20 |
| 2005/0137010 | A1 | 6/2005 | Enzminger et al. | 463/25 |
| 2005/0192088 | A1 | 9/2005 | Hartman et al. | 463/27 |
| 2005/0215313 | A1 | 9/2005 | O'Halloran | 463/26 |
| 2005/0239542 | A1 | 10/2005 | Olsen | 463/27 |
| 2005/0245309 | A1 | 11/2005 | Englman | 463/20 |
| 2006/0003829 | A1 | 1/2006 | Thomas | 463/20 |
| 2006/0019737 | A1 | 1/2006 | Yang | 463/19 |
| 2006/0025195 | A1 | 2/2006 | Pennington et al. | 463/16 |
| 2006/0025210 | A1 | 2/2006 | Johnson | 463/25 |
| 2006/0030403 | A1 | 2/2006 | Lafky et al. | 463/27 |
| 2006/0052159 | A1 | 3/2006 | Cahill et al. | 463/27 |
| 2006/0073877 | A1 | 4/2006 | Rodgers et al. | 463/20 |
| 2006/0073889 | A1 | 4/2006 | Edidin et al. | 463/27 |
| 2006/0116194 | A1* | 6/2006 | Pacey et al. | 463/20 |
| 2006/0116201 | A1 | 6/2006 | Gauselmann | 463/26 |
| 2006/0142079 | A1 | 6/2006 | Ikehara et al. | 463/27 |
| 2006/0142086 | A1 | 6/2006 | Blackburn et al. | 463/42 |
| 2006/0154718 | A1 | 7/2006 | Willyard et al. | 463/25 |
| 2006/0178203 | A1 | 8/2006 | Hughes et al. | 463/20 |
| 2006/0183535 | A1 | 8/2006 | Marks et al. | 463/20 |
| 2006/0183537 | A1 | 8/2006 | Dickerson | 463/27 |
| 2006/0183538 | A1 | 8/2006 | Michaelson et al. | 463/27 |
| 2006/0281527 | A1 | 12/2006 | Dunaevsky et al. | 463/20 |
| 2006/0287077 | A1 | 12/2006 | Grav et al. | 463/27 |
| 2007/0026941 | A1 | 2/2007 | Block et al. | 463/29 |
| 2007/0054733 | A1 | 3/2007 | Baerlocher | 463/27 |
| 2007/0060244 | A1 | 3/2007 | Yaldoo et al. | 463/16 |
| 2007/0060271 | A1 | 3/2007 | Cregan et al. | 463/16 |
| 2007/0060314 | A1 | 3/2007 | Baerlocher et al. | 463/25 |
| 2007/0060319 | A1 | 3/2007 | Block et al. | 463/27 |
| 2007/0060365 | A1 | 3/2007 | Tien et al. | 463/42 |
| 2007/0213114 | A1 | 9/2007 | Caspers et al. | 463/16 |
| 2010/0056252 | A1* | 3/2010 | Englman et al. | 463/20 |
| 2011/0117987 | A1* | 5/2011 | Aoki et al. | 463/20 |

FOREIGN PATENT DOCUMENTS

| | | | |
|---|---|---|---|
| DE | 195 15 983 | A1 | 11/1996 |
| DE | 196 24 321 | A1 | 1/1998 |
| EP | 0 521 599 | A1 | 1/1993 |
| GB | 2 153 572 | A | 8/1985 |
| GB | 2 181 589 | A | 4/1987 |
| GB | 2 242 300 | A | 9/1991 |
| GB | 2 313 792 | A | 10/1997 |
| GB | 2 333 880 | A | 8/1999 |
| WO | WO 99/03078 | A1 | 1/1999 |
| WO | WO 99/19037 | A1 | 4/1999 |
| WO | WO 01/33478 | A1 | 5/2001 |
| WO | WO 03/026754 | A1 | 4/2003 |
| WO | WO 03/083789 | A1 | 10/2003 |
| WO | WO 2005/099425 | A2 | 10/2005 |
| WO | WO 2006/039349 | A2 | 4/2006 |
| WO | WO 2008/057356 | A2 | 5/2008 |
| WO | WO 2008/156846 | A1 | 12/2008 |
| WO | WO 2009/032150 | A1 | 3/2009 |

OTHER PUBLICATIONS

International Preliminary Report on Patentability corresponding to International Patent Application Serial No. PCT/US2008/012206, dated Feb. 12, 2010; 4 pages.

Written Opinion of the International Searching Authority corresponding to International Application Serial No. PCT/US2008/012206, dated Jan. 8, 2009; 4 pages.

Article for "Easy Riches" by Sigma Game, Strictly Slots, 1 page (Aug. 2001).

Article for "Millioniser" by Glenn Haussman, Strictly Slots, pp. 50-53, 4 pages (Mar. 2004).

Product Sheet for "Big Games Safari," IGT, 24 pages (2000).

"New '97 Games," International Gaming & Wagering Business, 23 pages (Mar. 1997).

PCT International Search Report for International Application No. PCT/US2005/08951 dated Nov. 16, 2005 (3 pages).

PCT International Search Report for International Application No. PCT/US2007/023000 mailed May 22, 2008 (2 pages).

PCT International Written Opinion for International Application No. PCT/US2007/023000 mailed May 22, 2008 (6 pages).

"Spot the Dog" brochure. Olympic Video Gaming, 2 pages (undated).

* cited by examiner

GAMING SYSTEM HAVING FREE SPIN ENHANCEMENT FEATURES

CROSS REFERENCE TO RELATED APPLICATIONS

This application is a U.S. national stage filing of International Application No. PCT/2008/012206, filed Oct. 28, 2008, claiming priority from U.S. Provisional Application No. 61/001,475, filed Nov. 1, 2007, which are both incorporated herein by reference in their entirety.

COPYRIGHT

A portion of the disclosure of this patent document contains material, which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having selective free spin enhancement features.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

Traditionally, bonus games provided to supplement primary wagering games have been activated in response to bonus triggering outcomes achieved in the primary wagering game. One problem that arises is that an inherent predictability of the frequency and display of the bonus award occurs after repeated play of the wagering game. Another problem that occurs is that the amounts of bonus or secondary awards provided for certain bonus events triggered is fixed, causing the presentation of such awards to become repetitive and less exciting. Yet another problem with such traditional systems is that player's anticipation and excitement related to achieving bonus awards dissipates over repeated play of a wagering game, causing the game play experience to be less rewarding and thus, the game to be less desirable relative to other available wagering games. The present invention is directed to solving these and other problems.

SUMMARY OF THE INVENTION

According to one aspect of the present invention, a gaming system comprises a wager input device for receiving a primary wager, a display for displaying a primary wagering game, and a controller operative to (i) detect receipt of the primary wager, (ii) cause the display to present a randomly selected outcome of the primary wagering game, the randomly selected outcome selected from a plurality of possible outcomes, the plurality of possible outcomes including at least one free spin bonus outcome, (iii) determine if the randomly selected outcome is one of the at least one free spin bonus outcome; (iv) in response to the randomly selected outcome being the at least one free spin bonus outcome, provide a plurality of free spins and display a plurality of free spin enhancements which remain constant for the free spins; (v) enhance an outcome of each of the free spins based on a player selection of at least one of the free spin enhancements for a subsequent free spin and (vi) deactivating the selected at least one of the free spin enhancements after each subsequent free spin.

According to another aspect of the invention, a method of operating a wagering game comprises receiving a primary wager and displaying a randomly selected outcome of a primary wagering game, the randomly selected outcome selected from a plurality of possible outcomes, the plurality of possible outcomes including at least one free bonus outcome. The method further comprises determining if the randomly selected outcome is one of the at least one free spin bonus outcome and providing a plurality of free spins in response to the randomly selected outcome being the at least one free spin bonus outcome. The method further comprises displaying a plurality of free spin enhancements in response to the randomly selected outcome being the at least one free spin bonus outcome and enhancing an outcome of each of the free spins based on a player selection of at least one of the free spin enhancements for each subsequent free spin. The values of the plurality of free play enhancements remaining the same for the plurality of free plays. The method further comprising deactivating the selected at least one of the free play enhancements after selection and awarding the enhanced outcome of the free plays to the player.

According to yet another aspect of the invention, a method of operating a free-spin wagering game comprises providing a plurality of free spins; displaying a first outcome for the first spin of the plurality of free spins; and prior to displaying the first outcome, displaying a plurality of free spin enhancements to a player, values of each of the plurality of free spin enhancements remaining constant for the free spins. The method further comprises prior to displaying the first outcome, receiving a selection of at least one of the plurality of free spin enhancements; and enhancing the first outcome based on the selected at least one of the free spin enhancements. The method further comprises inactivating the selected at least one of the free spin enhancements for all remaining free spins after the first spin of the plurality of free spins.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
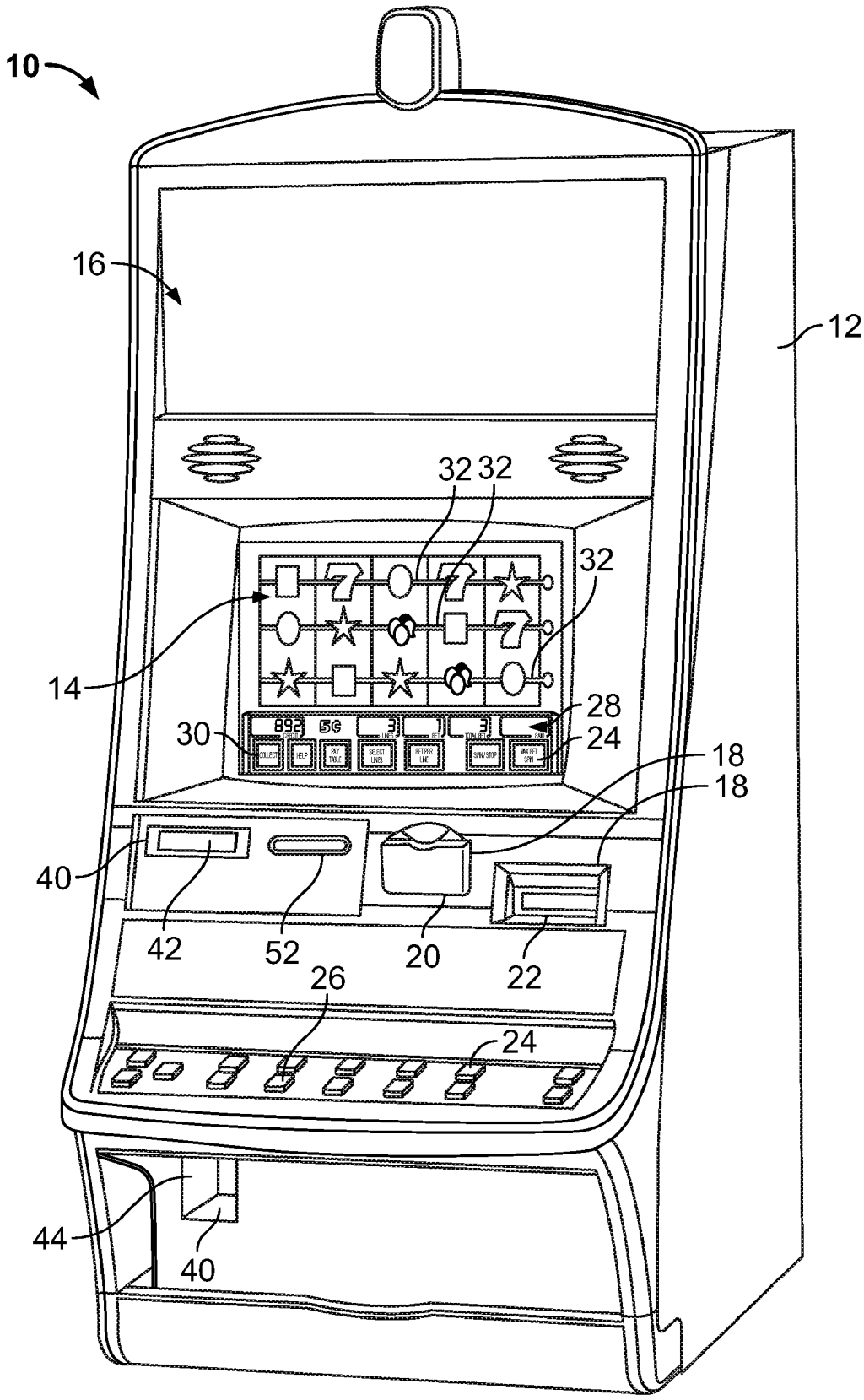
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 of the gaming machine 10 may include a number of mechanical reels to display the outcome in visual association with at least one payline 32. Alternatively, the primary display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a free spin bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
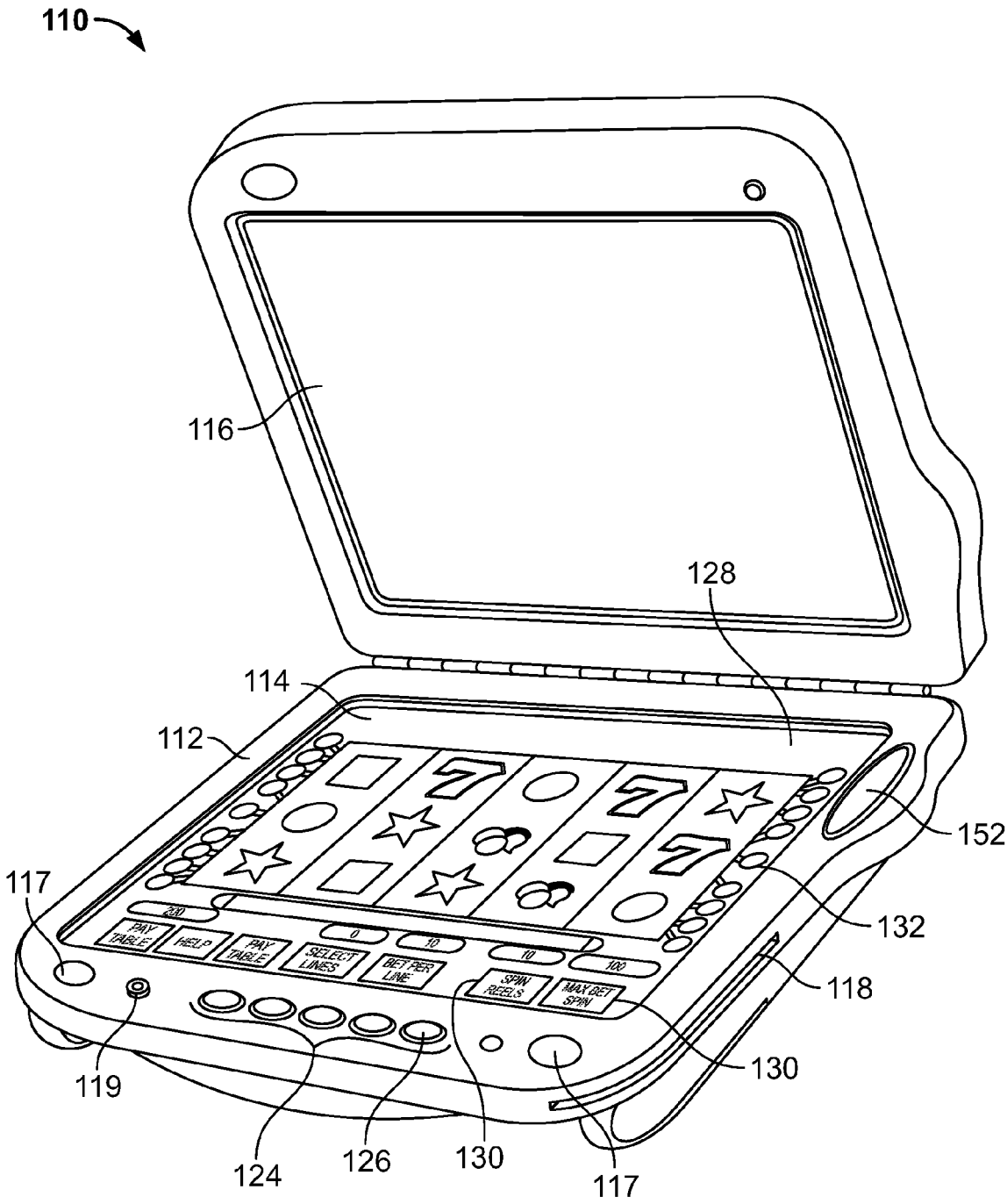
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably includes a number of mechanical reels to display the outcome in visual association with at least one payline. Alternatively, the primary display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a free spin bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
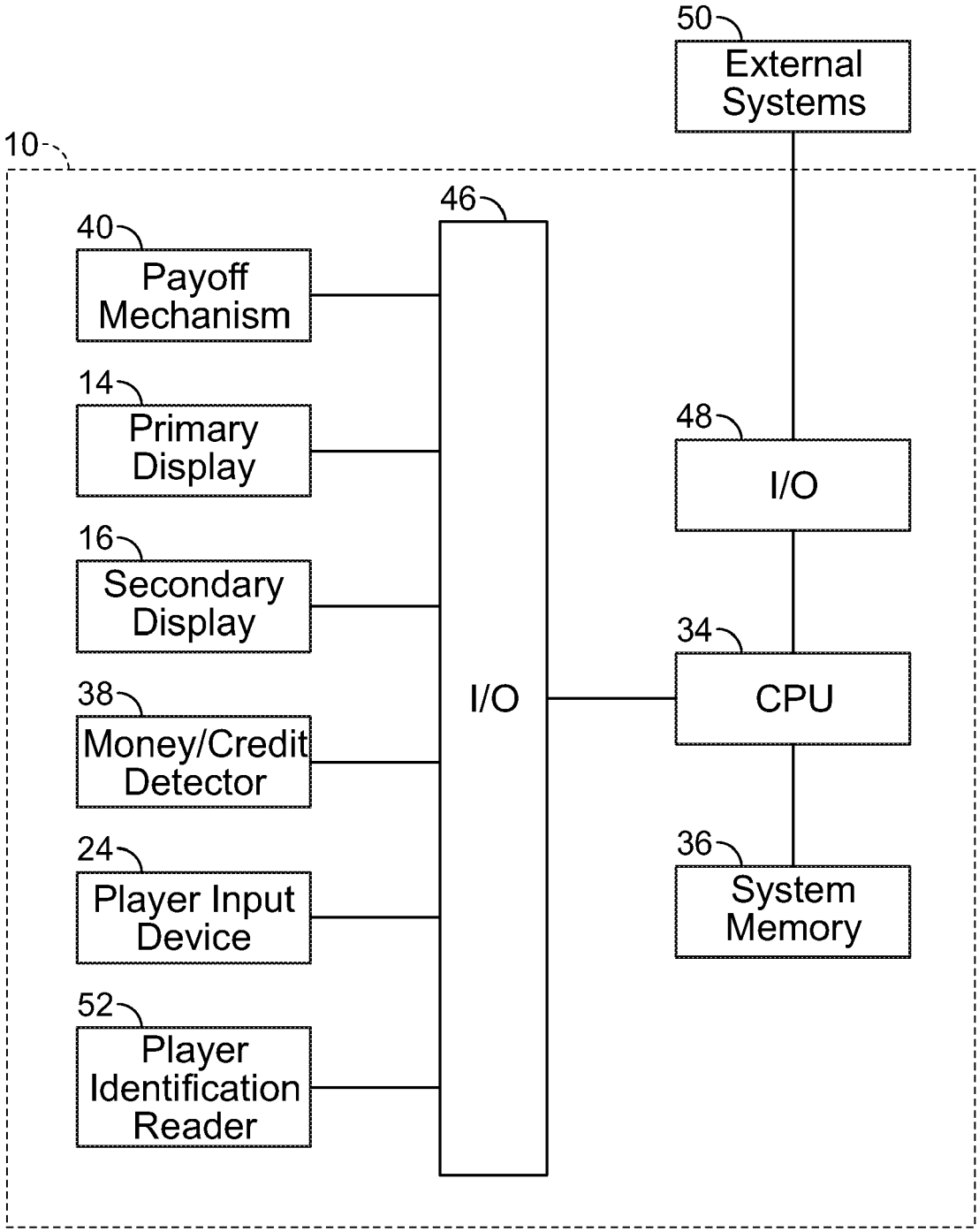
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
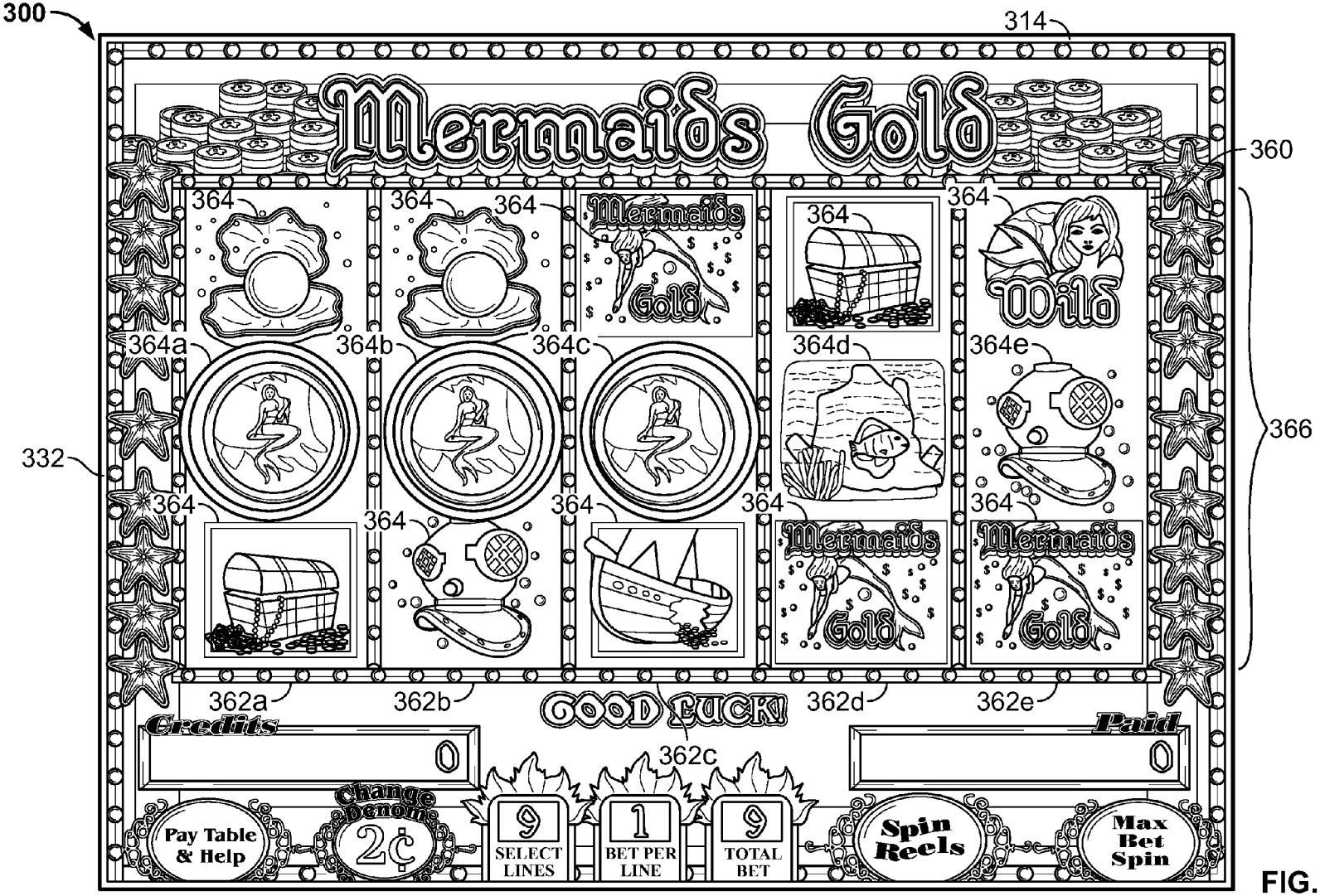
FIG. 3 is a screen shot of a primary display of a gaming system displaying a primary wagering game with a free spin bonus outcome.

Turning now to FIG. 3, a primary display 314 of a gaming device 10 or 110 is shown. The primary display 314 may be any form of display such as those described herein with reference to the free standing and handheld gaming devices of FIGS. 1*a* and 1*b*. The primary display 314 includes a display of a primary wagering game 360, which in this embodiment is a slot game as shown in FIG. 3. The slot game 360 includes a plurality of reels 362*a,b,c,d,e* which may be either electromechanical reels or simulations thereof on the primary display 314. The reels 362*a,b,c,d,e* include a plurality of symbols 364 displayed thereon that vary as the reels 362*a,b,c,d,e* are spun and stopped. The symbols 364 may include any variety of graphical symbols, elements, or representations, including symbols 364 which are associated with one or more themes of the gaming machine or system. The symbols 364 may also include a blank symbol or empty space. As described herein the symbols 364 landing on an active payline 332 (the paylines for which a wager has been received) are evaluated for free spin bonus outcomes. In the example shown in FIG. 3, a free spin bonus outcome is awarded when three or more gold mermaid coins 364*a*, 364*b* and 364*c* land on the active payline 332. In alternate embodiments, the free spin bonus outcome may be defined as any number of symbols or combinations of symbols in any payline or configuration. The symbols 364 on the reels 362*a,b,c,d,e* form an array 366 or matrix of symbols 364, having a number of rows and columns, which in the embodiment shown is three rows and five columns. In alternate embodiments, the array 366 may have greater or fewer symbols 364, and may take on a variety of different forms having greater or fewer rows and/or columns. The array 366 may even comprise other non-rectangular forms or arrangements of symbols 364.

Figure 4:
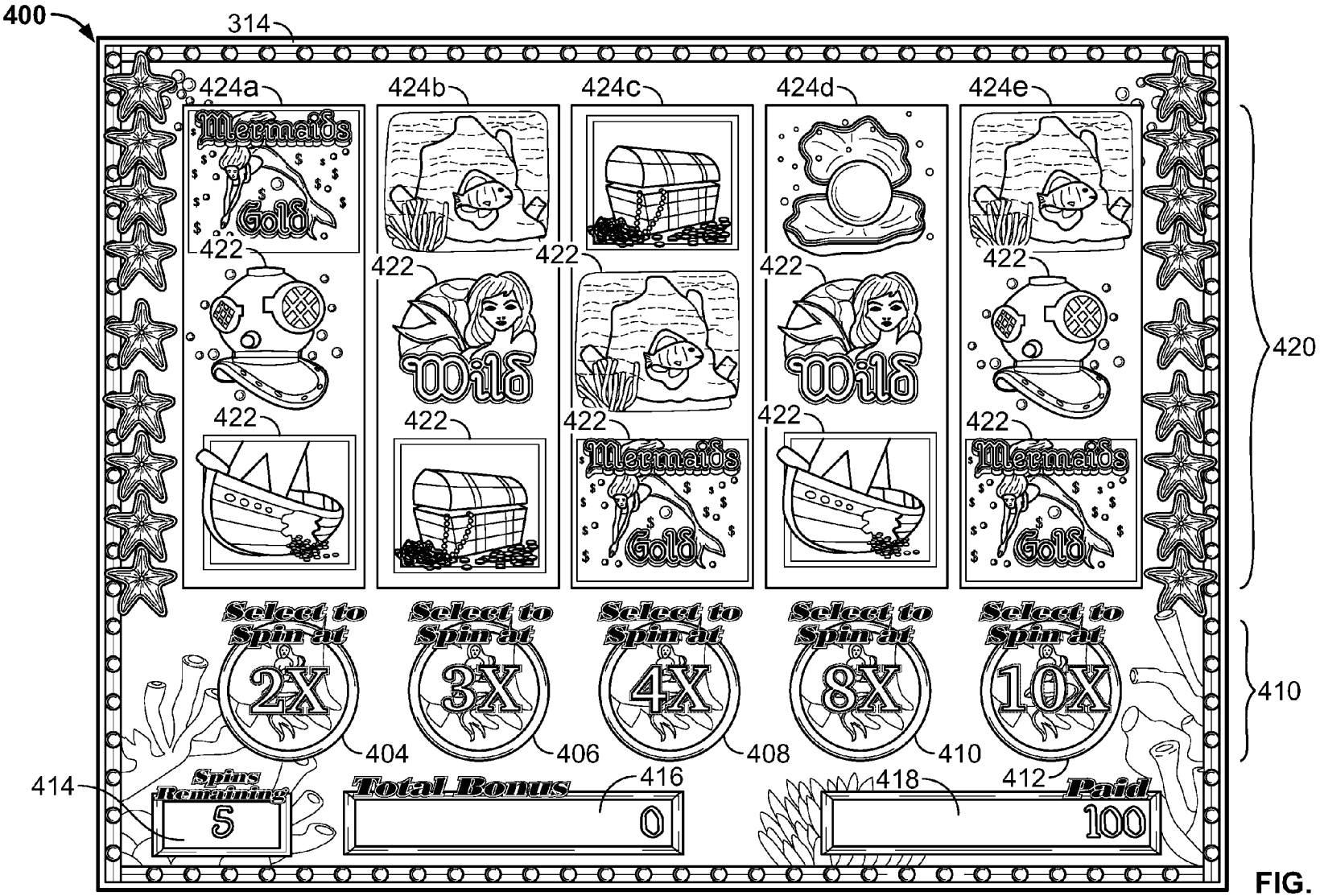
FIG. 4 is a screen shot of a free spin bonus displaying free spin enhancements.

Turning now to FIG. 4, a free spin bonus outcome 400 is displayed on the primary display 314 of the gaming device 10 or 110. A free spin enhancement control bar 402 appears along the bottom of the display 314 and includes a plurality of free spin enhancements, which may be buttons or keys 404, 406, 408, 410 and 412, for which inputs are sensed by a touch screen overlying the display 314. Moreover, a plurality of meters is displayed on the control bar 402, including a Free Spin Meter 414, a Bonus Meter 416, and a Paid Meter 418. The Free Spin Meter 414 displays the remaining number of free spins available to a player based upon the free spin bonus outcome obtained in the primary wagering game 360. The Bonus Meter 416 displays the cumulative amount of credits obtained by the player during the free spin bonus game 400. The amount of credits won by the player for a particular free spin is displayed in the Paid Meter 418.

In playing the free spin bonus game 400, a plurality of free spins is provided in response to the randomly selected outcome of the primary game being the at least one free spin bonus outcome. The free spin enhancements 404, 406, 408, 410 and 412 are displayed in response to the randomly selected outcome being the at least one free spin bonus outcome. Any number of methods may determine values of the free spin enhancements 404, 406, 408, 410, and 412. For example, the values may be predetermined for a specific free spin bonus outcome obtained in the basic game. Alternatively, or in addition to, the values of the free spin enhancements 404, 406, 408, 410 and 412 may be determined through a jackpot party implementation where the values are increased or decreased depending on the jackpot. In a jackpot party type implementation, the free spin enhancements 404, 406, 408, 410, and 412 may be increased based on the wagers made by the player. The jackpot party is described in U.S. Pat. No. 6,190,255, which is hereby incorporated in its entirety by reference. A big event type implementation may also determine the values of the free spin enhancements 404, 406, 408, 410, and 412. In a big event type implementation, the wagers made by the player within a certain period of time may determine the values of the free spin enhancements 404, 406, 408, 410 and 412. A player who wagers more in a shorter period of time would receive higher free spin enhancements than other players. The big event implementation is described in U.S. Published Patent Application No. 2006/0135243, which is hereby incorporated in its entirety by reference. Any number of methods may determine the values of the free spin enhancements 404, 406, 408, 410, and 412. The outcome of each of the free spins is enhanced based on a player selection of at least one of the free spin enhancements 404, 406, 408, 410, and 412 for each subsequent free spin. For example, the free spin enhancements 404, 406, 408, 410 and 412 may be displayed to a player upon beginning the free spin bonus game 400. The values of the free spin enhancements 404, 406, 408, 410 and 412 may remain constant during the free spin bonus game 400. The player selects one or more free spin enhancements 404, 406, 408, 410 and 412 for each subsequent free spin. Each free spin enhancement 404, 406, 408, 410, and 412 may be deactivated upon selection, so that each free spin enhancement 404, 406, 408, 410 and 412 is applied to a single subsequent free spin. Referring to FIG. 4 for example, the player may select the free spin enhancement 408 which would apply a four times multiplier to the value of the subsequent free spin. After such a selection, the free spin enhancement 408 is deactivated and no longer available.

Figure 5:
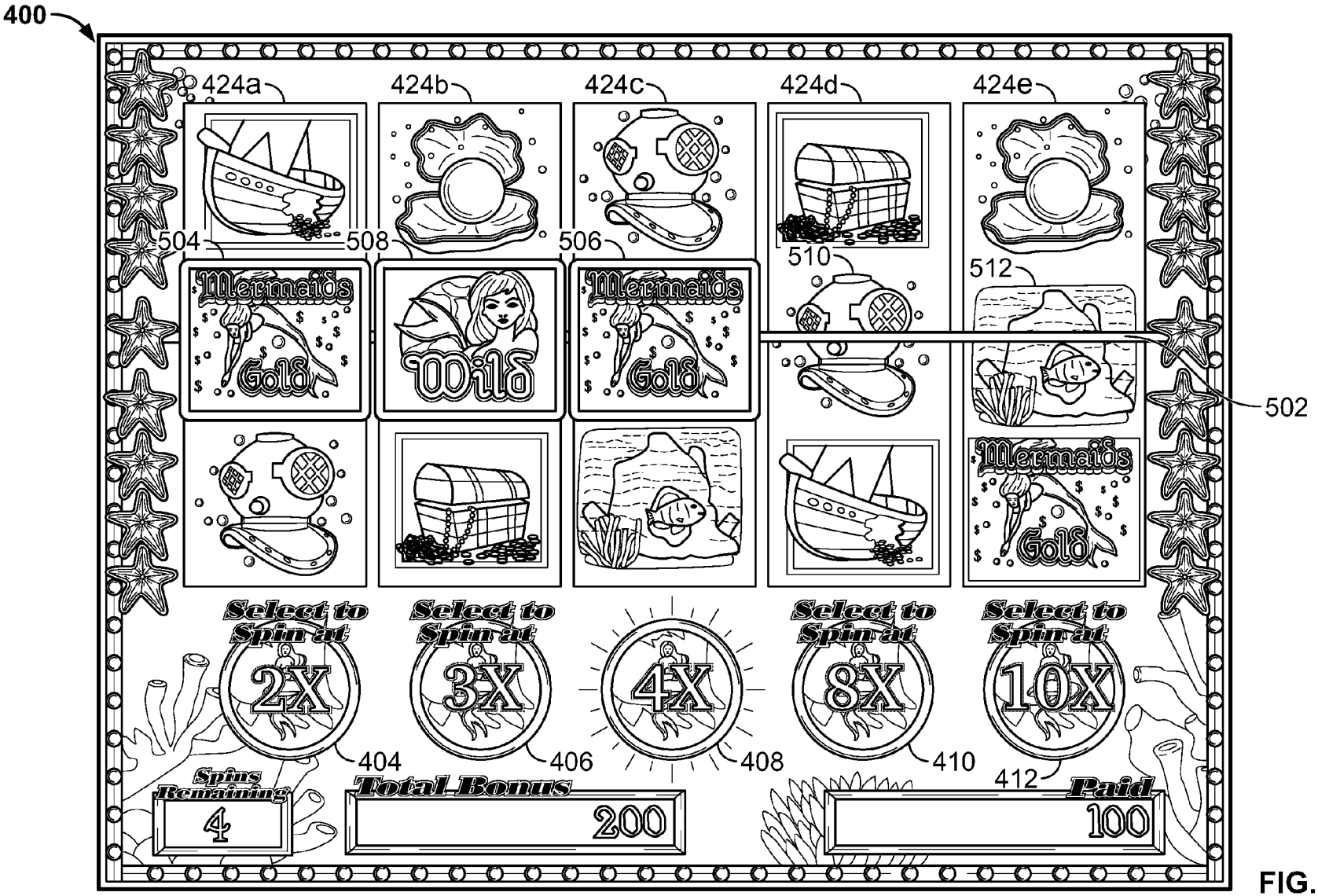
FIG. 5 is a screen shot of the free spin bonus of FIG. 4, displaying inactivation of one of the free spin enhancements.

Since the values of the free spin enhancements 404, 406, 408, 410 and 412 which are still active are displayed to the player before each free spin, the player has to decide which free spin enhancement 404, 406, 408, 410 and 412 to apply to which free spins. For example, the player may believe that the first free spin is the luckiest and therefore selects the highest free spin enhancement (in FIG. 5, free spin enhancement 412 of ten times). Alternatively, the player may believe that the first free spin is the least likely to result in a winning combination and, therefore, selects the lowest free spin enhancement (in FIG. 5, free spin enhancement 404 of two times). The player is thus able to decide on the best strategy for selecting the respective free spin enhancements 404, 406, 408, 410 and 412 based on the player's feel for the game. The player's interaction with the game 400 is enhanced with the player having control of the free spin enhancement 404, 406, 408, 410 and 412 selected for each free spin. The player's ability to select the respective free spin enhancement 404, 406, 408, 410 and 412 eliminates, or greatly reduces, the likelihood that the game 400 would become repetitive to the player since the selection of the free spin enhancement 404, 406, 408, 410 and 412 is controlled by the player.

It should be understood that in alternative embodiments, more than one free spin enhancement 404, 406, 408, 410 and 412 may be utilized simultaneously. In one embodiment, a player may select multiple free spin enhancements 404, 406, 408, 410 and 412. The selected multiple free spin enhancements may then be added together to calculate a sum which is then used to enhance a subsequent free spin outcome. For example, in FIG. 5, a player may select free spin enhancement 412, which is shown as a ten multiplier, and free spin enhancement 410, which is shown as an eight multiplier. The total free spin enhancement would then be calculated as a sum of ten plus eight or eighteen. Alternatively, the selected free spin enhancements 410, 412 may be multiplied together to result in a total free spin enhancement of a product of eighty.

After making the multiple free spin enhancement selection, the selected free spin enhancements may then be deactivated, or removed, for subsequent free spins. As will be apparent, the player may select all of the free spin enhancements 404, 406, 408, 410 and 412 before all of the free spins are played. In alternative embodiments, the remaining free spins after all free spin enhancements 404, 406, 408, 410 and 412 are inactivated, may be deleted or removed. Alternatively, the remaining free spins may be enhanced by a predetermined default enhancement. For example, all the remaining free spins may be enhanced by a multiplier of one or another preselected amount.

Turning again to FIG. 5, a randomly selected outcome of a play of the free spin bonus game 400 is displayed. As shown, the free spin enhancement 408 has been inactivated which indicates that the free spin enhancement 408, or a four multiplier, has been selected by the player and will be applied to the outcome of the subsequent free spin. The reels 424 of the free spin bonus game 400 have spun and stopped to display an outcome of the free spin bonus game 400 formed by the arrangement of the symbols 422 in the array 420. A single payline 502 was activated on this play of the free spin bonus game 400, as displayed. On this particular play of the free spin bonus game 400, a winning outcome has been achieved. The winning outcome in this instance comprises two gold mermaid symbols 504, 506 and a wild symbol 508 landing on the active payline 502. The award for the winning outcome is calculated as four times (the free spin enhancement 408) the award amount of 100 in the Paid Meter 418.

It should be understood that the free spin bonus game 400 may be displayed on a secondary display separate from the primary display 314, instead of or in addition to being displayed on the primary display 314.

It should be understood that the free spin bonus game 400 may be displayed on a secondary display separate from the primary display 314, instead of or in addition to being displayed on the primary display 314. The system 300 as described and shown in various embodiments herein, offers a number of advantages over traditional systems. Like traditional systems, a random determination of an outcome of a basic wagering game is made and the randomly selected outcome is presented to the player. If the randomly selected outcome is a winning outcome, the system provides a free spin bonus game feature which is activated to add a number of free spins and free spin enhancements. The operator of the system 300 can select the free spin enhancements individually or in groupings to be applied to subsequent free spins. Thus, to the player the system provides the player controlled strategy of which free spin enhancements to select and in what order to maximum the award obtained from the free spin bonus game.

Each of these embodiments and obvious variations thereof is contemplated as falling within the spirit and scope of the claimed invention, which is set forth in the following claims.

What is claimed is:

1. A gaming system comprising:

a wager input device for receiving a primary wager;

a display for displaying a randomly selected outcome of a primary wagering game; and a controller operative to:

(i) detect receipt of the primary wager;

(ii) cause the display to present the randomly selected outcome selected from a plurality of possible outcomes, the plurality of possible outcomes including an at least one free spin bonus outcome;

(iii) determine if the randomly selected outcome is the at least one free spin bonus outcome;

(iv) in response to the randomly selected outcome being the at least one free spin bonus outcome, provide a plurality of free spins and display a plurality of free spin enhancements, each of the plurality of free spins enhancements having a value associated therewith, the values remaining constant for the plurality of free spins;

(v) enhance an outcome of a subsequent free spin based on a player selection of at least one of the free spin enhancements for the subsequent free spin; and (vi) deactivate the selected at least one of the free spin enhancements after the subsequent free spin.

2. The gaming system of claim 1, wherein the player selection of at least one of the free spin enhancements comprises player selection of one free spin enhancement for enhancing an outcome of a subsequent free spin.

3. The gaming system of claim 2, wherein the at least one free spin enhancement is at least one multiplier.

4. The gaming system of claim 1, wherein the player selection of at least one of the free spin enhancements comprises player selection of multiple free spin enhancements for enhancing an outcome of a subsequent free spin.

5. The gaming system of claim 4, wherein a sum of the selected multiple free spin enhancements enhances the outcome of the subsequent free spin.

6. The gaming system of claim 5, wherein a product of the selected multiple free spin enhancements enhances the outcome of the subsequent free spin.

7. The gaming system of claim 1, wherein, when all of the at least one of the free spin enhancements have been selected and have enhanced a subsequent free spin, all subsequent free spins are enhanced by a predetermined default enhancement.

8. The gaming system of claim 7, wherein the predetermined default enhancement equals a multiplier of one.

9. The gaming system of claim 1, wherein, when all of the at least one of the free spin enhancements have been selected and have enhanced a subsequent free spin, all remaining free spins are inactivated.

10. A method of operating a wagering game comprising:

receiving a primary wager;

displaying a randomly selected outcome of a primary wagering game, the randomly selected outcome selected from a plurality of possible outcomes, the plurality of possible outcomes including an at least one bonus outcome;

determining if the randomly selected outcome is the at least one bonus outcome;

providing a plurality of free plays in response to the randomly selected outcome being the at least one bonus outcome;

displaying a plurality of free play enhancements in response to the randomly selected outcome being the at least one bonus outcome, values of the plurality of free play enhancements remaining the same for the plurality of free plays;

enhancing an outcome of each of the free plays based on a player selection of at least one of the free play enhancements for each subsequent free play;

deactivating the selected at least one of the free play enhancements after selection; and awarding the enhanced outcome of the free plays to the player.

11. The method of claim 10, wherein the step of enhancing an outcome further comprises the step of selecting a plurality of the free play enhancements for at least one of the free plays.

12. The method of claim 11, wherein the step of selecting a plurality of free play enhancements further comprises the step of determining a sum of the plurality of free play enhancements and, wherein the step of enhancing an outcome further comprises the step of enhancing an outcome of the subsequent free play by the sum.

13. The method of claim 12, wherein the at least one free play enhancement is at least one multiplier.

14. The method of claim 12, further comprising the step of, when all of the free play enhancements have been selected and have enhanced a subsequent free play, enhancing all further free plays by a predetermined default enhancement.

15. The method of claim 14, wherein the predetermined default enhancement is multiplier of one.

16. The method of claim 12, wherein, when all of the free play enhancements have been selected and have enhanced a subsequent free play, all remaining free plays are inactivated.

17. A method of operating a free-spin wagering game comprising:

providing a plurality of free spins;

displaying a first outcome for the first spin of the plurality of free spins;

prior to displaying the first outcome, displaying a plurality of free spin enhancements to a player, values of each of the plurality of free spin enhancements remaining constant for the free spins;

prior to displaying the first outcome, receiving a selection of at least one of the plurality of free spin enhancements;

enhancing the first outcome based on the selected at least one of the free spin enhancements; and inactivating the selected at least one of the free spin enhancements for all remaining free spins after the first spin of the plurality of free spins.

18. The method of claim 17, wherein at least two of the plurality of free spin enhancements are multipliers.

19. The method of claim 18, further comprising the step of multiplying the at least two multipliers, in response to the at least two multipliers being selected, to produce a product, and wherein the product is used to enhance either the first outcome or a single subsequent free spin outcome, whichever occurs immediately after the selection of the at least two multipliers.

20. The method of claim 18, further comprising the step of adding the at least two multipliers, in response to the at least two multipliers being selected, to produce a sum and wherein the sum is used to enhance either the first outcome or a single subsequent free spin outcome, whichever occurs immediately after the selection of the at least two multipliers.

* * * * *